US006135034A

United States Patent [19]

Clark

[11] Patent Number: 6,135,034

[45] Date of Patent: Oct. 24, 2000

[54] TRASH CAN SAFE

[76] Inventor: Arlene J. Clark, 4308 Bitter Root Dr., Las Vegas, Nev. 89030

[21] Appl. No.: 09/345,843

[22] Filed: Jul. 1, 1999

[51] Int. Cl.[7] ..... E05G 1/00

[52] U.S. Cl. ..... 109/54; 109/45; 109/59 R; 109/57; 220/4.27

[58] Field of Search ..... 109/45, 49, 53–59 R; 70/DIG. 81; 220/4.06, 4.07, 4.04, 4.26, 4.27

[56] References Cited

U.S. PATENT DOCUMENTS

| | | | |
|---|---|---|---|
| 1,810,080 | 6/1931 | Kegel | 220/4.27 X |
| 1,887,866 | 11/1932 | Belknap | 109/59 R |
| 1,908,806 | 5/1933 | Allen | 220/4.27 X |
| 2,073,636 | 3/1937 | Holoubek | 220/4.27 X |
| 2,086,018 | 7/1937 | Dyer | 109/54 X |
| 2,669,198 | 2/1954 | Campbell | 109/59 R |
| 3,183,863 | 5/1965 | Jeffres | 109/59 R |
| 3,899,983 | 8/1975 | Hernandez | 109/53 X |
| 4,113,332 | 9/1978 | McMaster | 109/54 X |
| 4,119,231 | 10/1978 | Johnson | 220/4.27 X |
| 4,123,978 | 11/1978 | Lentini | 109/54 X |
| 4,244,303 | 1/1981 | Kurasik | 109/54 X |
| 4,457,240 | 7/1984 | Hungerford | 109/45 |
| 5,048,901 | 9/1991 | DeBlaay | 312/204 |
| 5,066,079 | 11/1991 | Lawrence | 109/54 X |
| 5,386,922 | 2/1995 | Jordan | 220/4.27 X |
| 5,488,914 | 2/1996 | Ouellette | 109/59 R X |
| 5,542,206 | 8/1996 | Lisch | 220/4.27 X |
| 5,890,614 | 4/1999 | Dancyger | 220/4.27 X |

*Primary Examiner*—Suzanne Dino Barrett

[57] ABSTRACT

A trash can safe for hiding and storing valuables. The trash can safe includes a base and a perimeter side wall upwardly extending around the base to define an interior space. A plurality of stackable trays are provided in the interior space. The trays are stackable on each other to form a stack of trays such that each tray substantially covers the space of the tray therebelow. A lid is provided for substantially covering a top tray of the stack of trays.

12 Claims, 3 Drawing Sheets

TRASH CAN SAFE

BACKGROUND OF THE INVENTION

1. Field of the Invention

The present invention relates to trash can safes and more particularly pertains to a new trash can safe for hiding and storing valuables.

2. Description of the Prior Art

The use of trash can safes is known in the prior art. More specifically, trash can safes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,066,079; U.S. Pat. No. 4,113,332; U.S. Pat. No. Des. 312,160; U.S. Pat. No. 5,048,901; U.S. Pat. No. 4,252,387; and U.S. Pat. No. 4,955,505.

While these devices fulfill their respective, particular objectives and requirements, the aforementioned patents do not disclose a new trash can safe. The inventive device includes a base and a perimeter side wall upwardly extending around the base to define an interior space. A plurality of stackable trays are provided in the interior space. The trays are stackable on each other to form a stack of trays such that each tray substantially covers the space of the tray therebelow. A lid is provided for substantially covering a top tray of the stack of trays.

In these respects, the trash can safe according to the present invention substantially departs from the conventional concepts and designs of the prior art, and in so doing provides an apparatus primarily developed for the purpose of hiding and storing valuables.

SUMMARY OF THE INVENTION

In view of the foregoing disadvantages inherent in the known types of trash can safes now present in the prior art, the present invention provides a new trash can safe construction wherein the same can be utilized for hiding and storing valuables.

The general purpose of the present invention, which will be described subsequently in greater detail, is to provide a new trash can safe apparatus and method which has many of the advantages of the trash can safes mentioned heretofore and many novel features that result in a new trash can safe which is not anticipated, rendered obvious, suggested, or even implied by any of the prior art trash can safes, either alone or in any combination thereof.

To attain this, the present invention generally comprises a base and a perimeter side wall upwardly extending around the base to define an interior space. A plurality of stackable trays are provided in the interior space. The trays are stackable on each other to form a stack of trays such that each tray substantially covers the space of the tray therebelow. A lid is provided for substantially covering a top tray of the stack of trays.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new trash can safe apparatus and method which has many of the advantages of the trash can safes mentioned heretofore and many novel features that result in a new trash can safe which is not anticipated, rendered obvious, suggested, or even implied by any of the prior art trash can safes, either alone or in any combination thereof.

It is another object of the present invention to provide a new trash can safe which may be easily and efficiently manufactured and marketed.

It is a further object of the present invention to provide a new trash can safe which is of a durable and reliable construction.

An even further object of the present invention is to provide a new trash can safe which is susceptible of a low cost of manufacture with regard to both materials and labor, and which accordingly is then susceptible of low prices of sale to the consuming public, thereby making such trash can safe economically available to the buying public.

Still yet another object of the present invention is to provide a new trash can safe which provides in the apparatuses and methods of the prior art some of the advantages thereof, while simultaneously overcoming some of the disadvantages normally associated therewith.

Still another object of the present invention is to provide a new trash can safe for hiding and storing valuables.

Yet another object of the present invention is to provide a new trash can safe which includes a base and a perimeter side wall upwardly extending around the base to define an interior space. A plurality of stackable trays are provided in the interior space. The trays are stackable on each other to form a stack of trays such that each tray substantially covers the space of the tray therebelow. A lid is provided for substantially covering a top tray of the stack of trays.

Still yet another object of the present invention is to provide a new trash can safe that allows a user to safely store valuables in a manner that is easily accessible when the user desires to retrieve the valuables.

Even still another object of the present invention is to provide a new trash can safe that won't be accidentally thrown away such as safes designed to resemble soft drink cans or hairspray canisters.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
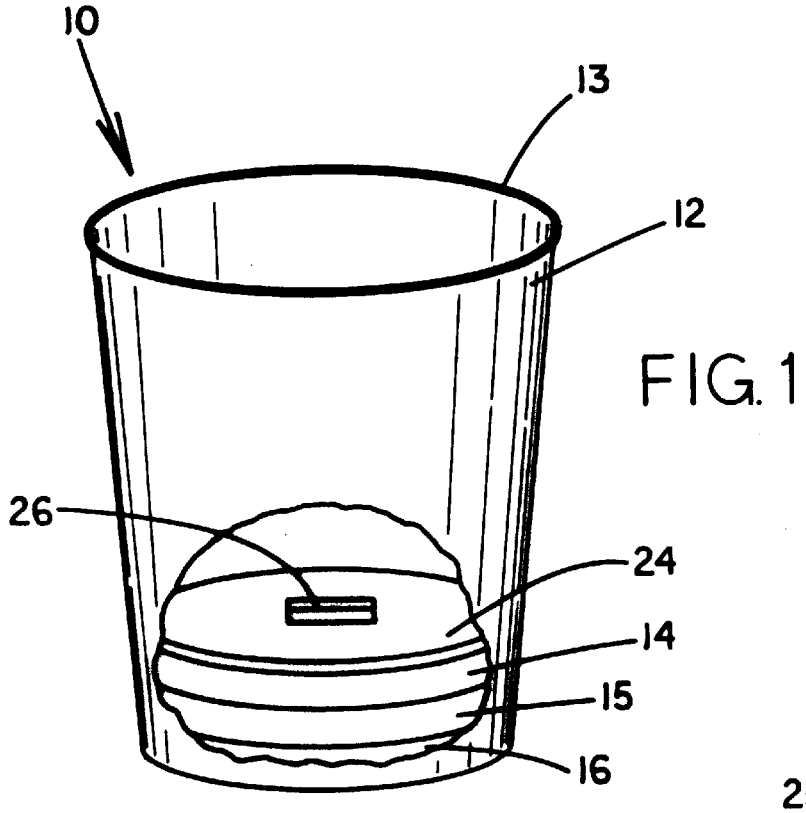
FIG. 1 is a schematic perspective breakaway view of a new trash can safe according to the present invention.
Figure 2:
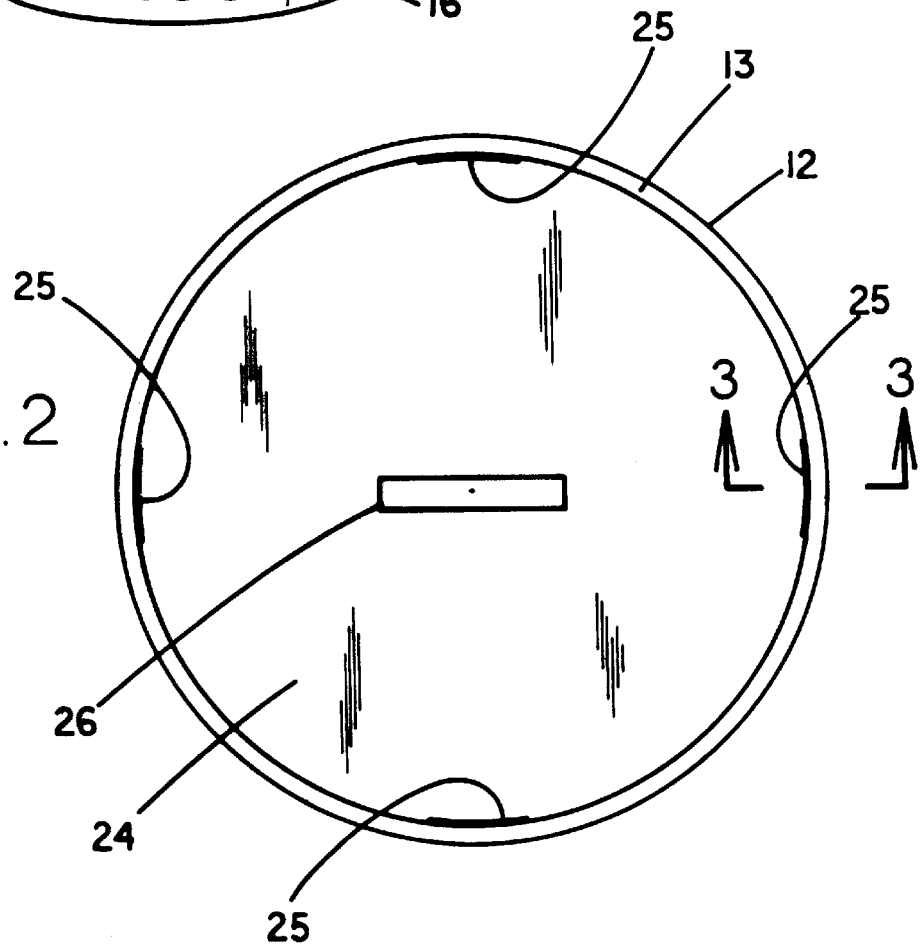
FIG. 2 is a schematic top view of the present invention.

With reference now to the drawings, and in particular to FIGS. 1 through 7 thereof, a new trash can safe embodying the principles and concepts of the present invention and generally designated by the reference numeral 10 will be described.

As best illustrated in FIGS. 1 through 7, the trash can safe 10 generally comprises a base 11 and a perimeter side wall 12 upwardly extending around the base 11 to define an interior space. A plurality of stackable trays 14,15,16 are provided in the interior space. The trays 14,15,16 are stackable on each other to form a stack of trays such that each tray substantially covers the space of the tray therebelow. A lid 24 is provided for substantially covering a top tray 14 of the stack of trays.

In closer detail the trash can safe 10 includes a container configured to resemble a trash can and having a base 11 and a perimeter side wall 12. The a base 11 is preferably generally circular (although it may also be rectangular or oval) and has an outer perimeter. The perimeter side wall 12 is upwardly extended from the base 11 around the outer perimeter of the base 11. Ideally, the perimeter side wall 12 flares outwards from the base 11 such that the perimeter side wall 12 has a generally frusto-conical configuration. Together, the perimeter side wall 12 and the base 11 define an interior space with the upper edge 13 of the perimeter side wall 12 defining a top opening into the interior space.

Figure 3:
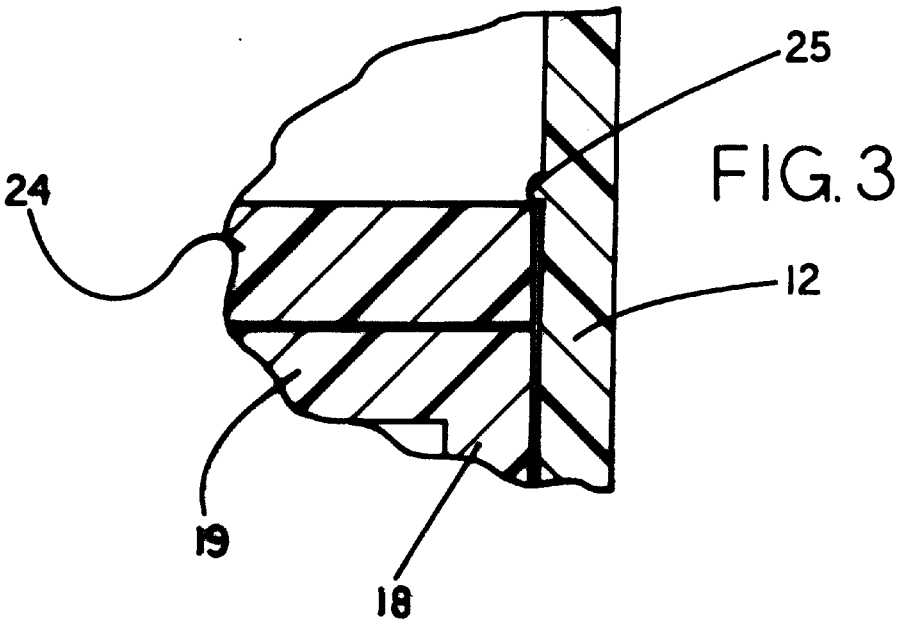
FIG. 3 is a schematic partial cross sectional view of the present invention taken from line 3—3 on FIG. 2.
Figure 4:
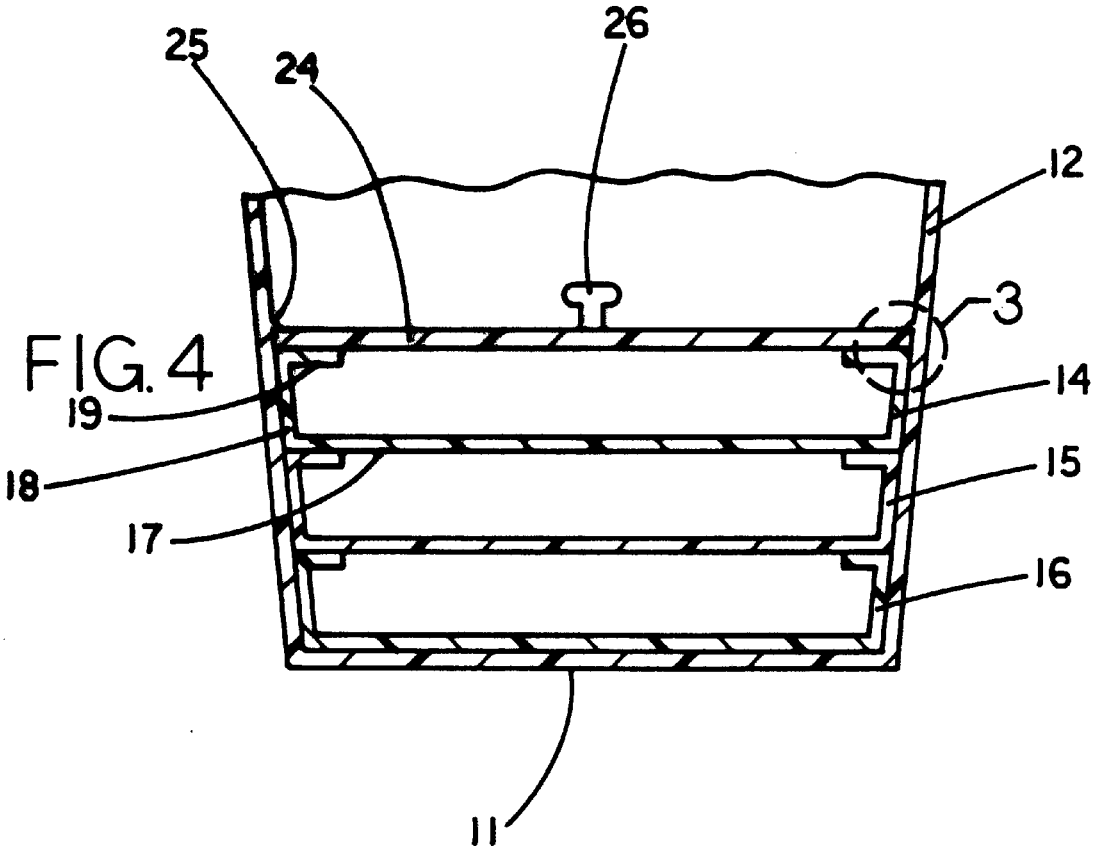
FIG. 4 is a schematic cross sectional view of the present invention.
Figure 5:
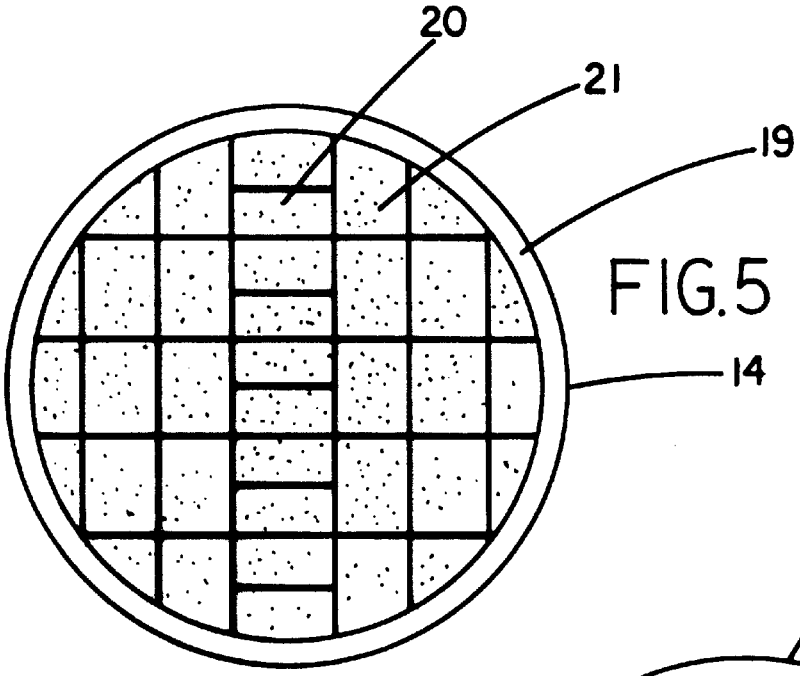
FIG. 5 is a schematic top view of the top tray of the present invention.
Figure 6:
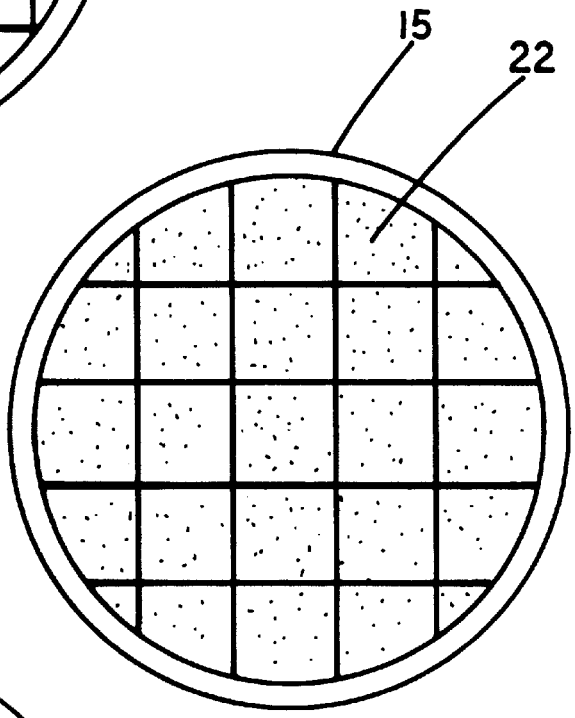
FIG. 6 is a schematic top view of a middle tray of the present invention.
Figure 7:
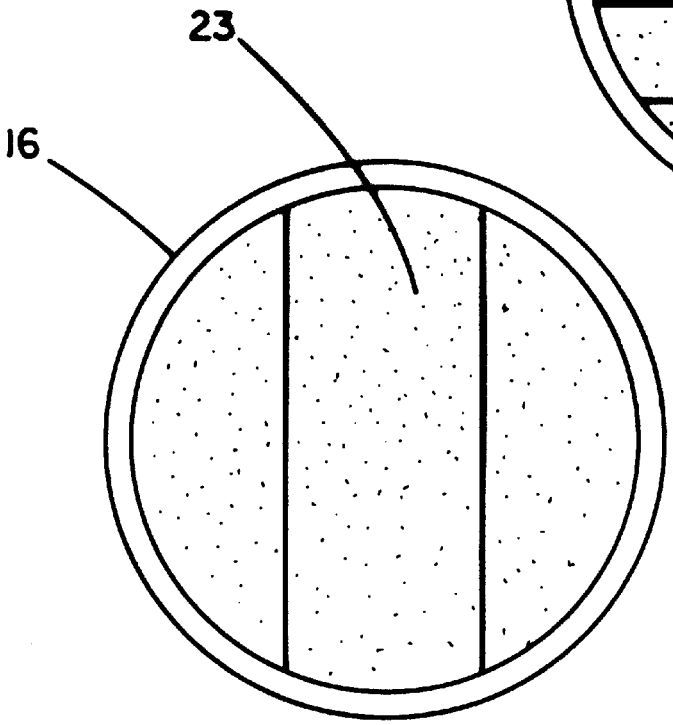
FIG. 7 is a schematic top view of a bottom tray of the present invention.

Provided in the interior space are a plurality of stackable trays 14,15,16. Each of the trays 14,15,16 has a bottom panel 17 and a perimeter lip 18 extending around the perimeter of the bottom panel 17. The perimeter lip 18 of each tray defines a space for holding items such as jewelry, money, and important documents therein. The trays 14,15,16 are stackable on each other to form a stack of trays such that each tray substantially covers the space of the tray that it rests on. Ideally, the stack of trays comprises three trays. Preferably, the perimeter lip 18 of each of the trays 14,15,16 has an annular resting flange 19 extending radially inwards from the upper edge of the perimeter lip 18. The trays 14,15,16 are restable on one another in the stack such that the bottom panel 17 of a tray rests on the resting flange 19 of another tray below it. Also preferably, the perimeter lips 18 of the trays 14,15,16 are positioned close to the interior surface of the perimeter side wall 12 when the trays 14,15,16 are stacked and rested on the base 11 as best illustrated in FIG. 3. Ideally, the bottom panel 17 of each of the trays 14,15,16 is generally circular. In the flared perimeter side wall embodiment, each of the trays 14,15,16 has a diameter larger than the diameter of the tray it rests on such that the trays 14,15,16 conform to the shape of the perimeter side wall 12 when the trays 14,15,16 are stacked in the interior space.

Preferably, the space of each of the trays 14,15,16 is divided into a plurality of compartments 20,21,22,23. Ideally, one of the trays 14 has compartments adapted for holding rings 20 and earrings 21 therein. In this ideal embodiment, another of the trays 15 preferably has compartments 22 adapted for holding pendants, necklaces, and chains therein while a third of the trays 16 has compartments 23 adapted for holding money and important documents therein. Preferably, the interior surfaces of the trays 14,15,16 facing into the space of each tray have a soft felt-like coating provided thereon for helping prevent damage to items held in the tray from rubbing and other movement against the surfaces of the tray.

A lid 24 is provided for substantially covering the top of a top tray 14 of the stack of trays 14,15,16 to prevent items from spilling from the top tray 14. In use, trash may be placed in the interior space of the container on top of the lid. The lid 24 is preferably generally circular to conform to the inner surface of the perimeter side wall 12. In use, the lid 24 is rested on the resting flange 19 of the tray on the top tray 14 of the stack of trays. The perimeter side wall 12 has a plurality of spaced apart and inwardly extending holding ridges 25. The holding ridges 25 are adapted for releasably holding the lid 24 on the top tray 14 of the stack of trays 14,15,16 when the lid 24 and the stack of trays 14,15,16 are in the interior space. The holding ridges 25 comprise a resiliently deflectable material such that the lid 24 is held in place on the top tray 14 when the container is tilted or turned upside-down and such that the holding ridges 25 release the lid 24 when the lid 24 is pulled in an upwards direction. Ideally, the holding ridges 25 are generally equidistantly spaced apart in a circle around the perimeter side wall 12. The lid 24 also has an upwardly extending handle 26 which is preferably centrally position on the lid 24. The handle 26 is designed for permitting the lifting of the lid 24 in an upwards direction to release the lid 24 from the holding ridges 25 to uncover the top tray 14 and to permit removal of the stack of the trays 14,15,16 from the interior space.

Preferably, the height of the perimeter side wall 12 is greater than the diameter or width of the base 11. Also preferably, the height of the trays 14,15,16 (measured from the bottom panel 17 to the upped edge of the lip) are generally equal to one another. Preferably, the stack of trays 14,15,16 has a height less than about one third the height of the perimeter side wall 12 measured upwards from the base 11. Ideally, the stack of the trays 14,15,16 has a height less than about one-fourth the height of the height of the tray so that it appears to a casual observer that there is no false bottom to the container.

In the ideal embodiment, the container, the lid 24, and the trays 14,15,16 are all constructed from a plastic.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A trash can safe, comprising:

a container having a base and a perimeter side wall upwardly extending around said base to define an interior space;

a plurality of stackable trays being provided in said interior space;

said trays being stackable on each other to form a stack of trays such that each tray substantially covers the space of the tray therebelow;

a lid for substantially covering a top tray of the stack of trays; and wherein said stack of trays has a height substantially less than said height of said perimeter side wall measured upwards from said base such that said container may be used as a receptacle while concealing said stack of trays from incidental surveillance.

2. The trash can safe of claim 1, wherein said base is generally circular.

3. The trash can safe of claim 2, wherein said perimeter side wall flares outwards from said base such that said perimeter side wall has a generally frusto-conical configuration.

4. The trash can safe of claim 1, wherein each of said trays has a bottom panel and a perimeter lip, said perimeter lip of each of said trays having a resting flange extending radially inwards therefrom, said trays being restable on one another in a stack such that the bottom panel of a tray rests on the resting flange of another tray therebelow.

5. The trash can safe of claim 1, wherein each of said trays is divided into a plurality of compartments.

6. The trash can safe of claim 1, wherein said perimeter side wall has a plurality of spaced apart and inwardly extending holding ridges, said holding ridges being adapted for releasably holding said lid on said top tray of said stack of trays when said lid and said stack of trays are in said interior space.

7. The trash can safe of claim 1, wherein said lid having an upwardly extending handle.

8. The trash can safe of claim 7, wherein said handle is centrally position on said lid.

9. The trash can safe of claim 1, wherein said height of said perimeter side wall is greater that the diameter or width of said base.

10. The trash can safe of claim 9, wherein said height of said trays measured from said bottom panel to said upper edge of said lip are generally equal to one another.

11. The trash can safe of claim 1, wherein said stack of trays has a height less than about one third said height of said perimeter side wall measured upwards from said base such that more than about two thirds of said height of said container is available for holding trash on top of said lid covering said top tray.

12. A trash can safe, comprising:

a container configured to resemble a trash can and having a base and a perimeter side wall, said base being generally circular and having an outer perimeter;

said perimeter side wall being upwardly extended around said outer perimeter of said base, said perimeter side wall flaring outwards from said base such that said perimeter side wall has a generally frusto-conical configuration;

said perimeter side wall and said base defining an interior space, said perimeter side wall having an upper edge defining a top opening into said interior space;

a plurality of stackable trays being provided in said interior space, wherein said plurality of trays comprises three trays;

each of said trays having a bottom panel and a perimeter lip extending around said perimeter of said bottom panel, said perimeter lip defining a space for holding items therein;

said trays being stackable on each other to form a stack of trays such that each tray substantially covers the space of the tray therebelow;

said perimeter lips of said trays are positioned close to said interior surface of said perimeter side wall when said trays are stacked and rested on said base;

wherein said bottom panel of each of said trays is generally circular, each of said trays having a diameter larger than that said diameter of said tray it rests on such that said trays conform to said shape of said perimeter side wall when said trays are stacked in said interior space;

said perimeter lip of each of said trays having a resting flange extending radially inwards therefrom, said trays being restable on one another in a stack such that the bottom panel of a tray rests on the resting flange of another tray therebelow;

wherein said space of each of said trays is divided into a plurality of compartments;

a lid for substantially covering a top tray of the stack of trays to prevent items from spilling from said top tray, said lid being generally circular to conform to the inner surface of said perimeter side wall, said lid being rested on said resting flange of the tray on the top tray of the stack of trays;

said perimeter side wall having a plurality of spaced apart and inwardly extending holding ridges, said holding ridges being adapted for releasably holding said lid on said top tray of said stack of trays when said lid and said stack of trays are in said interior space, wherein said holding ridges are generally equidistantly spaced apart in a circle around the perimeter side wall, wherein said holding ridges comprise a resiliently deflectable material such that said lid is held in place on said top tray when said container is tilted or turned upside-down, said holding ridges releasing said lid when said lid is pulled in an upwards direction;

said lid having an upwardly extending handle, said handle being centrally position on said lid, said handle being for permitting the lifting of said lid in an upwards direction to release the lid from said holding ridges to uncover the top tray and to permit removal of the stack of the trays from the interior space;

wherein said height of said perimeter side wall is greater that the diameter or width of said base, wherein said height of said trays measured from said bottom panel to said upper edge of said lip are generally equal to one another; and wherein said stack of trays has a height less than about one third said height of said perimeter side wall measured upwards from said base such that said container may be used as a refuse receptacle while concealing said stack of trays from incidental surveillance.

* * * * *